US011674776B2

(12) United States Patent
Yeates

(10) Patent No.: US 11,674,776 B2
(45) **Date of Patent: *Jun. 13, 2023**

(54) OVERMOLDED / THROUGH-MOLDED POUCH

(71) Applicant: Sentry Solutions Products Group LLC, Virginia Beach, VA (US)

(72) Inventor: Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/000,928

(22) Filed: Aug. 24, 2020

(65) Prior Publication Data

US 2020/0386514 A1 Dec. 10, 2020

Related U.S. Application Data

(63) Continuation-in-part of application No. 16/462,308, filed as application No. PCT/US2018/024320 on Mar. 26, 2018.

(60) Provisional application No. 62/476,836, filed on Mar. 26, 2017.

(51) Int. Cl.
*F41C 33/02* (2006.01)
*F41C 33/04* (2006.01)

(52) U.S. Cl.
CPC ..... *F41C 33/0245* (2013.01); *F41C 33/0218* (2013.01); *F41C 33/0236* (2013.01); *A45F 2200/0591* (2013.01); *F41C 33/041* (2013.01)

(58) Field of Classification Search
CPC ..... F41C 33/0245; F41C 33/0218; F41C 33/0236; F41C 33/041; F41C 33/02
See application file for complete search history.

(56) References Cited

U.S. PATENT DOCUMENTS

| | | | | |
|---|---|---|---|---|
| 8,925,773 | B2 * | 1/2015 | Clifton | F41C 33/0263 224/243 |
| 2002/0047029 | A1 * | 4/2002 | Liao | F41C 33/041 224/244 |
| 2002/0134803 | A1 * | 9/2002 | Lowe | F41C 33/0209 224/243 |
| 2005/0040195 | A1 * | 2/2005 | Lowe | F41C 33/0236 224/243 |
| 2006/0156525 | A1 * | 7/2006 | Jenkins | F41C 33/0209 29/407.1 |
| 2007/0181619 | A1 | 8/2007 | Seyfert et al. | |

(Continued)

*Primary Examiner* — Derek J Battisti
(74) *Attorney, Agent, or Firm* — Shaddock Law Group, PC

(57) ABSTRACT

An overmolded/through-molded pouch, having one or more wall portions defining a pouch body, wherein the pouch body extends from a substantially open top portion to a bottom portion, and wherein the one or more wall portions define an at least partial pouch cavity of the pouch body; at least one overmold aperture formed through a portion of one or more of the one or more wall portions; and an overmolding material extending atop at least a portion of an exterior surface of the pouch body, wherein at least a portion of the overmolding material extends through the at least one overmold aperture, such that at least a portion of the overmolding material extends through at least a portion of the at least one overmold aperture and into at least a portion of the at least partial pouch cavity.

20 Claims, 10 Drawing Sheets

(56) References Cited

U.S. PATENT DOCUMENTS

| | | | | |
|---|---|---|---|---|
| 2008/0105721 | A1 | 5/2008 | Har-Shen | |
| 2012/0328814 | A1* | 12/2012 | Atance Orden | B29C 45/1625<br>428/36.91 |
| 2013/0327799 | A1 | 12/2013 | Sitz | |
| 2014/0103083 | A1* | 4/2014 | Sitz | F41C 33/0245<br>224/255 |
| 2015/0041507 | A1 | 2/2015 | Pellegrini | |
| 2015/0247701 | A1* | 9/2015 | Faifer | F41C 33/0209<br>224/244 |

* cited by examiner

OVERMOLDED / THROUGH-MOLDED POUCH

CROSS-REFERENCE TO RELATED APPLICATIONS

This patent application claims the benefit of U.S. patent application Ser. No. 16/462,308, filed May 20, 2019, which is a 371 of PCT/US18/24320 Mar. 26, 2018, which claims the benefit of U.S. Patent Application Ser. No. 62/476,836, filed Mar. 26, 2017, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of pouches, cases, or carriers. More specifically, the presently disclosed systems, methods, and/or apparatuses relate to an overmolded/through-molded pouch, adaptable to be used with an item or accessory.

2. Description of Related Art

It is generally known to carry an item or accessory in a pouch designed to protect the item or accessory and hold it securely. Pouches can be worn in a number of ways, such as on a belt at the waist, on the thigh, attached or coupled to a plate carrier or tactical vest, or around an ankle.

In certain instances, an item or accessory must be secured or retained within the pouch, but quickly and easily removed from the pouch, regardless of the type of pouch used. Additionally, users need to be assured that, when not in use, the item or accessory will remain safely in the pouch.

Some pouches rely solely on frictional engagement between surfaces of the interior pouch cavity of the pouch and the item or accessory to secure the item or accessory within the pouch cavity of the pouch. Certain other pouches include a strap or other mechanism, which secures the item or accessory within the pouch until the strap or other mechanism is manipulated to allow the item or accessory to be withdrawn from the pouch.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, typical pouch designs have various shortcomings. In certain pouches, the tolerance or fit between one or more of the interior surfaces of the pouch cavity and an inserted item or accessory allows for a relatively high degree of play between the inserted item or accessory and the pouch. Thus, the item or accessory is able to shake or wobble within the pouch. If the degree of play between the inserted item or accessory and the pouch is too great, the item or accessory may wobble a sufficient amount to slide by or avoid any locking lever or mechanism and unintentionally fall out of or be withdrawn from the pouch.

Additionally, the material used to form the pouch may have a relatively smooth or slick surface, which does not provide a desired level of frictional engagement between the interior of the pouch and the outer surface of the inserted item or accessory.

In order to overcome these and other shortcomings of the currently known pouch designs and/or to provide an improved pouch, in various exemplary, non-limiting embodiments, the overmolded/through-molded pouch of the present disclosure comprises one or more wall portions defining a pouch body, wherein said pouch body extends from a substantially open top portion to a bottom portion, and wherein said one or more wall portions define an at least partial pouch cavity extending from said substantially open top portion; at least one overmold aperture formed through a portion of one or more of said one or more wall portions; and an overmolding material extending atop at least a portion of an exterior surface of said pouch body, wherein at least a portion of said overmolding material extends through said at least one overmold aperture, such that at least a portion of said overmolding material extends through at least a portion of said at least one overmold aperture and into at least a portion of said at least partial pouch cavity.

In various exemplary, nonlimiting embodiments, a longitudinal axis of the pouch body extends generally from the top portion to a bottom portion.

In various exemplary, nonlimiting embodiments, at least a portion of the at least partial pouch cavity is contoured to accommodate a specific type of item or accessory to be retained within the overmolded/through-molded pouch.

In various exemplary, nonlimiting embodiments, at least a portion of at least one of the one or more wall portions is contoured to accommodate a specific type of item or accessory to be retained within the overmolded/through-molded pouch.

In various exemplary, nonlimiting embodiments, the pouch body is substantially rigid.

In various exemplary, nonlimiting embodiments, the overmolding material is substantially resilient.

In various exemplary, nonlimiting embodiments, the overmolding material is formed of a rubber or silicone.

In various exemplary, nonlimiting embodiments, one or more overmold recess ridge segments extend from at least a portion of the exterior surface of the pouch body to define an overmold recess, wherein the at least one overmold aperture is formed through a portion of one or more of the one or more wall portions within the overmold recess, and wherein the overmolding material extends within the overmold recess.

In various exemplary, nonlimiting embodiments, at least one overmold recess is formed in at least a portion of an exterior surface of the pouch body, wherein the at least one overmold aperture is formed through a portion of one or more of the one or more wall portions within the overmold recess, and wherein the overmolding material extends within the overmold recess.

In various exemplary, nonlimiting embodiments, at least one overmold recess is formed in at least a portion of an exterior surface of the pouch body, wherein the at least one overmold aperture is formed through a portion of one or more of the one or more wall portions within the overmold recess, and wherein the overmolding material extends only within the overmold recess.

In various exemplary, nonlimiting embodiments, at least a portion of a surface of the overmolding material is textured to provide an ornamental appearance to at least a portion of the surface of the overmolding material.

In various exemplary, nonlimiting embodiments, at least a portion of a surface of the overmolding material includes tactile variations.

In various exemplary, non-limiting embodiments, the present disclosure provides an overmolded/through-molded pouch, including at least some of one or more wall portions defining a pouch body portion, wherein the one or more wall portions define an at least partial pouch cavity of the pouch body portion; at least one overmold recess formed in at least a portion of an exterior surface of the pouch body portion, wherein at least one overmold aperture is formed through a portion of one or more of the one or more wall portions within the overmold recess; and an overmolding material formed atop at least a portion of an exterior surface of the pouch body portion, within the at least one overmold recess, wherein at least a portion of the overmolding material extends through the at least one overmold aperture as one or more through-body protrusions, wherein each through-body protrusion extends through at least a portion of the at least one overmold aperture and into at least a portion of the at least partial pouch cavity.

In various exemplary, nonlimiting embodiments, the pouch body is substantially rigid.

In various exemplary, nonlimiting embodiments, one or more overmold recess ridge segments extend from at least a portion of the exterior surface of the pouch body to define the at least one overmold recess.

In various exemplary, nonlimiting embodiments, the overmolding material extends only within the overmold recess.

In various exemplary, nonlimiting embodiments, the overmolding material is substantially resilient.

In various exemplary, nonlimiting embodiments, an outer surface of the overmolding material is substantially coplanar with an outer surface of the pouch body, outside of the at least one overmold recess.

In various exemplary, nonlimiting embodiments, at least a portion of a surface of the overmolding material is textured.

In various exemplary, non-limiting embodiments, the present disclosure provides a method for producing an overmolded/through-molded pouch, including at least some of providing one or more wall portions defining a pouch body portion, wherein the one or more wall portions define an at least partial pouch cavity of the pouch body portion, and wherein at least one overmold aperture is formed through a portion of one or more of the one or more wall portions; providing at least one overmold recess formed in at least a portion of an exterior surface of the pouch body portion, wherein at least one overmold aperture is formed through a portion of one or more of the one or more wall portions within the overmold recess; and providing an overmolding material atop at least a portion of an exterior surface of the pouch body portion, within the overmold recess, wherein at least a portion of the overmolding material extends through the at least one overmold aperture as one or more through-body protrusions, wherein each through-body protrusion extends through at least a portion of the at least one overmold aperture and into at least a portion of the at least partial pouch cavity.

Accordingly, the overmolded/through-molded pouch of the present disclosure separately and optionally provides an item or accessory pouch having an at least partially overmolded surface.

The overmolded/through-molded pouch of the present disclosure separately and optionally provides an item or accessory pouch having one or more through-body protrusions, which extend into an at least partial pouch cavity from an at least partially overmolded surface.

The overmolded/through-molded pouch of the present disclosure separately and optionally provides an item or accessory pouch, which reduces or eliminates wobble or play between portions of the at least partial pouch cavity and an item or accessory seated within the at least partial pouch cavity.

The overmolded/through-molded pouch of the present disclosure separately and optionally provides an item or accessory pouch, which is able to accommodate a variety of styles or types of items or accessories within a given pouch.

The presently disclosed systems, methods, and/or apparatuses separately and optionally provide an overmolded/through-molded pouch that can be manufactured to accommodate a variety of item or accessories.

The presently disclosed systems, methods, and/or apparatuses separately and optionally provide an overmolded/through-molded pouch that can provide multiple exterior options for a single pouch body.

The presently disclosed systems, methods, and/or apparatuses separately and optionally provide an overmolded/through-molded pouch that can provide multiple interior cavity options for a single pouch body.

The presently disclosed systems, methods, and/or apparatuses separately and optionally provide an overmolded/through-molded pouch that can be manufactured to accommodate a variety of items.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
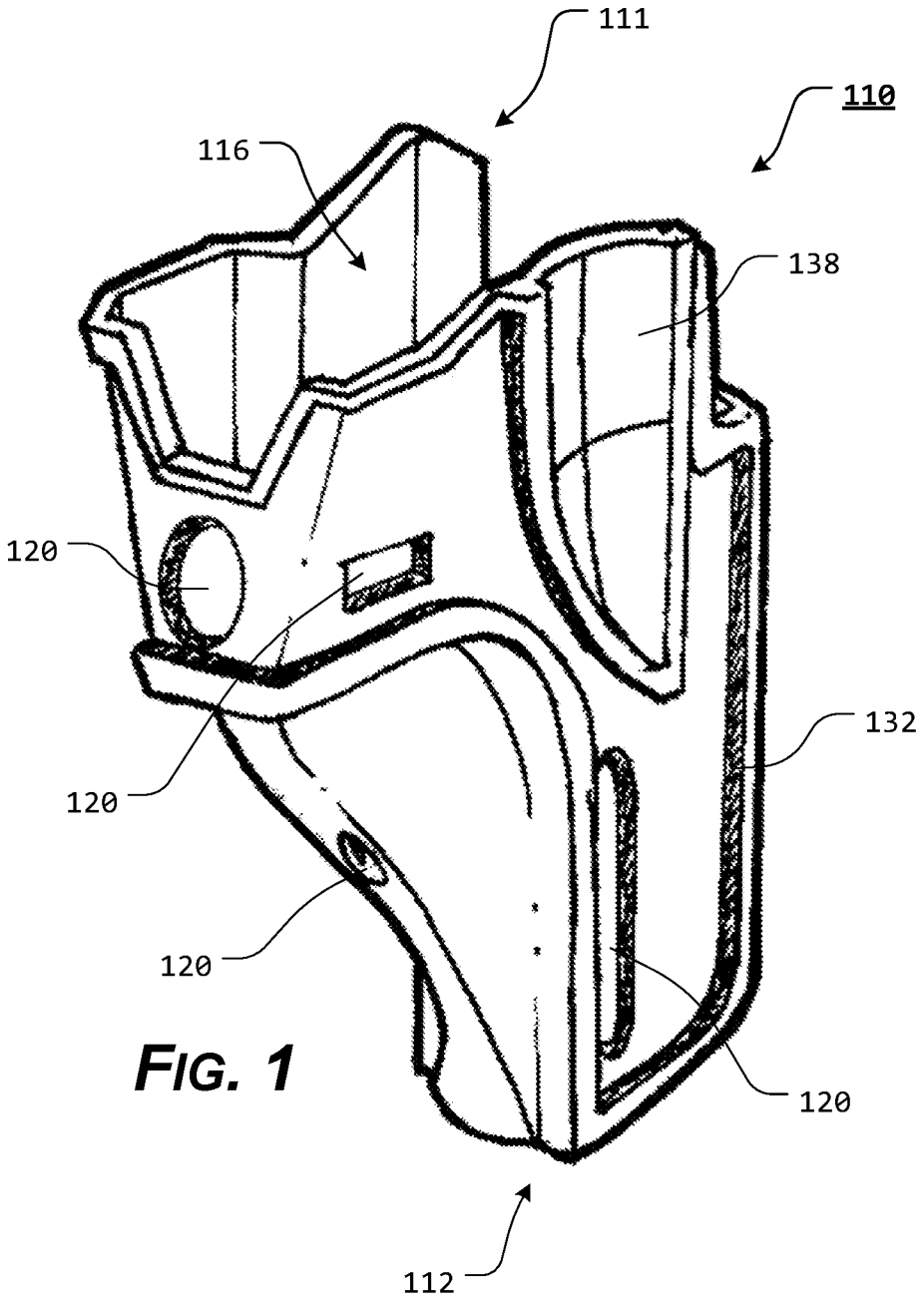
FIG. 1 illustrates a rear perspective view of an exemplary embodiment of a pouch body, according to the presently disclosed systems, methods, and/or apparatuses.
Figure 2:
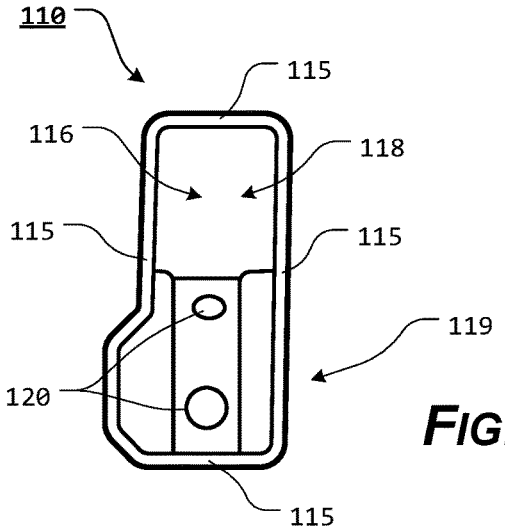
FIG. 2 illustrates a top view of an exemplary embodiment of a pouch body, according to the presently disclosed systems, methods, and/or apparatuses.
Figure 3:
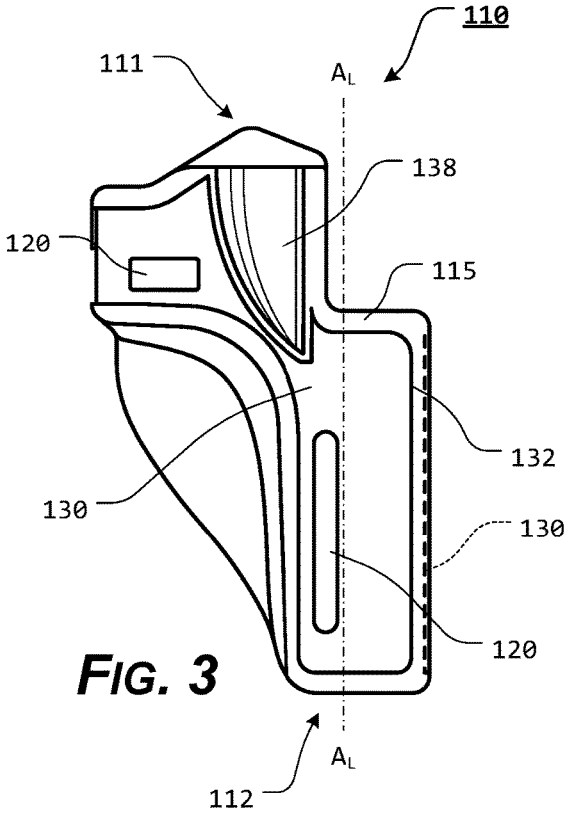
FIG. 3 illustrates a right side view of an exemplary embodiment of a pouch body, according to the presently disclosed systems, methods, and/or apparatuses.
Figure 4:
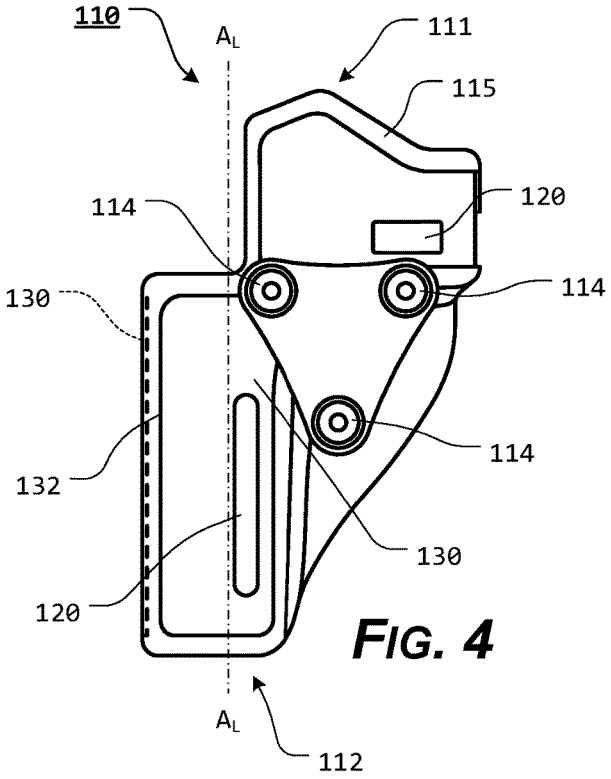
FIG. 4 illustrates a left side view of an exemplary embodiment of a pouch body, according to the presently disclosed systems, methods, and/or apparatuses.
Figure 5:
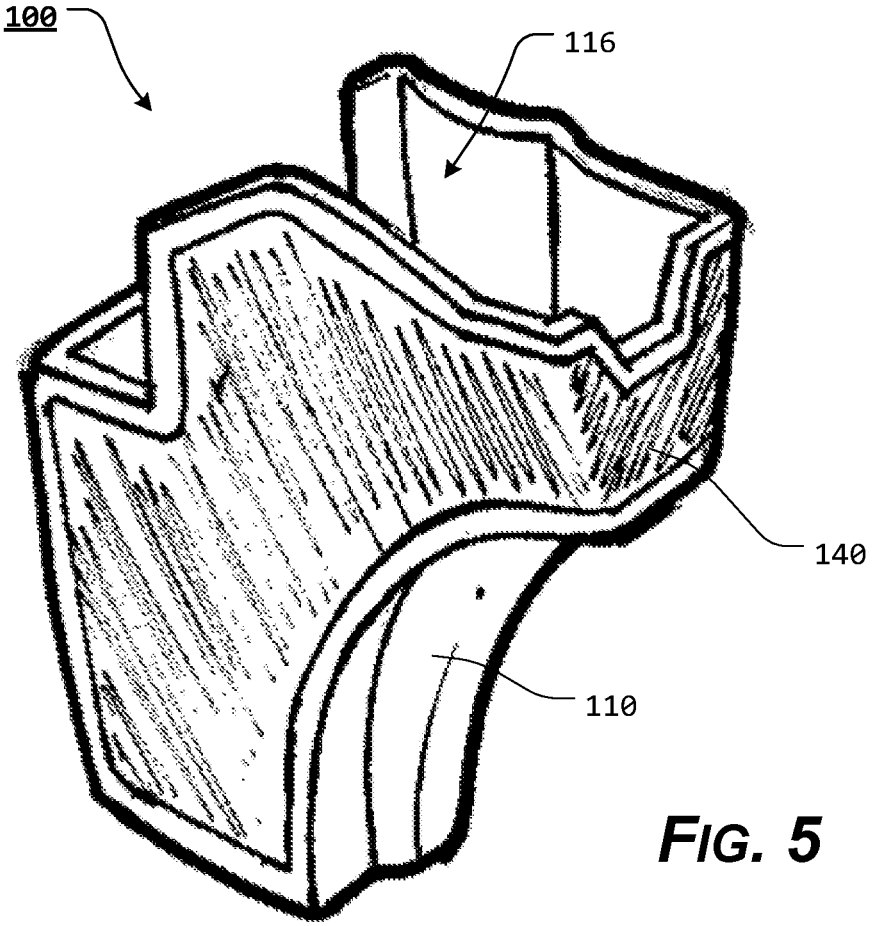
FIG. 5 illustrates an upper, rear, perspective view of an exemplary embodiment of an overmolded/through-molded pouch, according to the presently disclosed systems, methods, and/or apparatuses.
Figure 6:
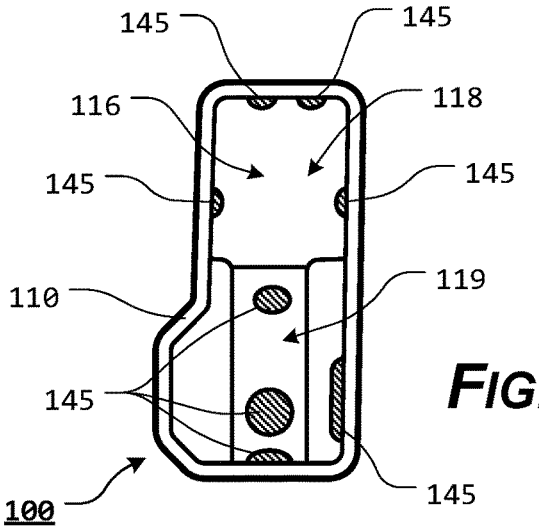
FIG. 6 illustrates a top view of an exemplary embodiment of an overmolded/through-molded pouch, according to the presently disclosed systems, methods, and/or apparatuses.
Figure 7:
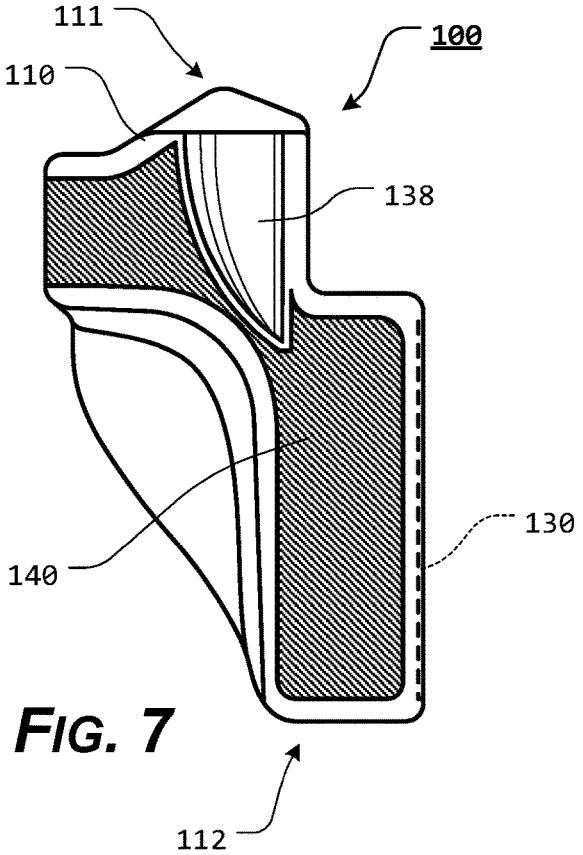
FIG. 7 illustrates a right side view of an exemplary embodiment of an overmolded/through-molded pouch, according to the presently disclosed systems, methods, and/or apparatuses.
Figure 8:
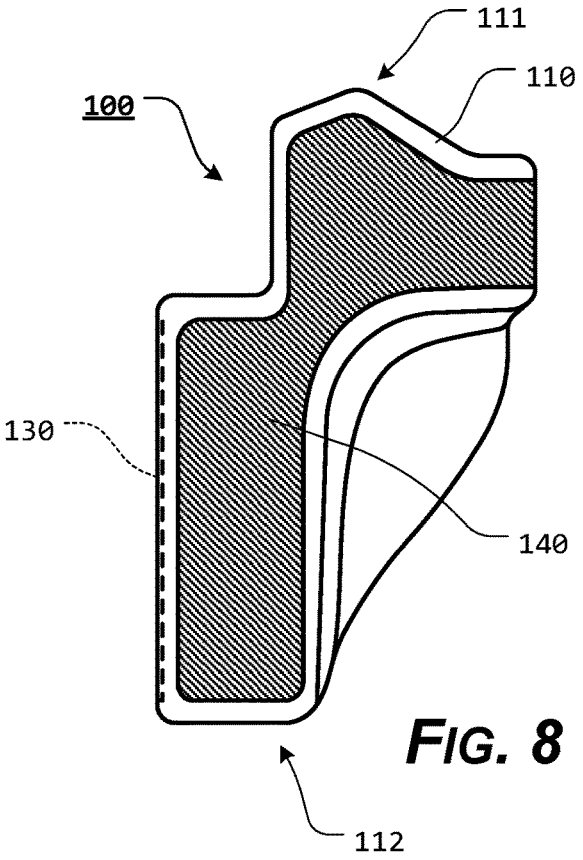
FIG. 8 illustrates a left side view of an exemplary embodiment of an overmolded/through-molded pouch, according to the presently disclosed systems, methods, and/or apparatuses.
Figure 9:
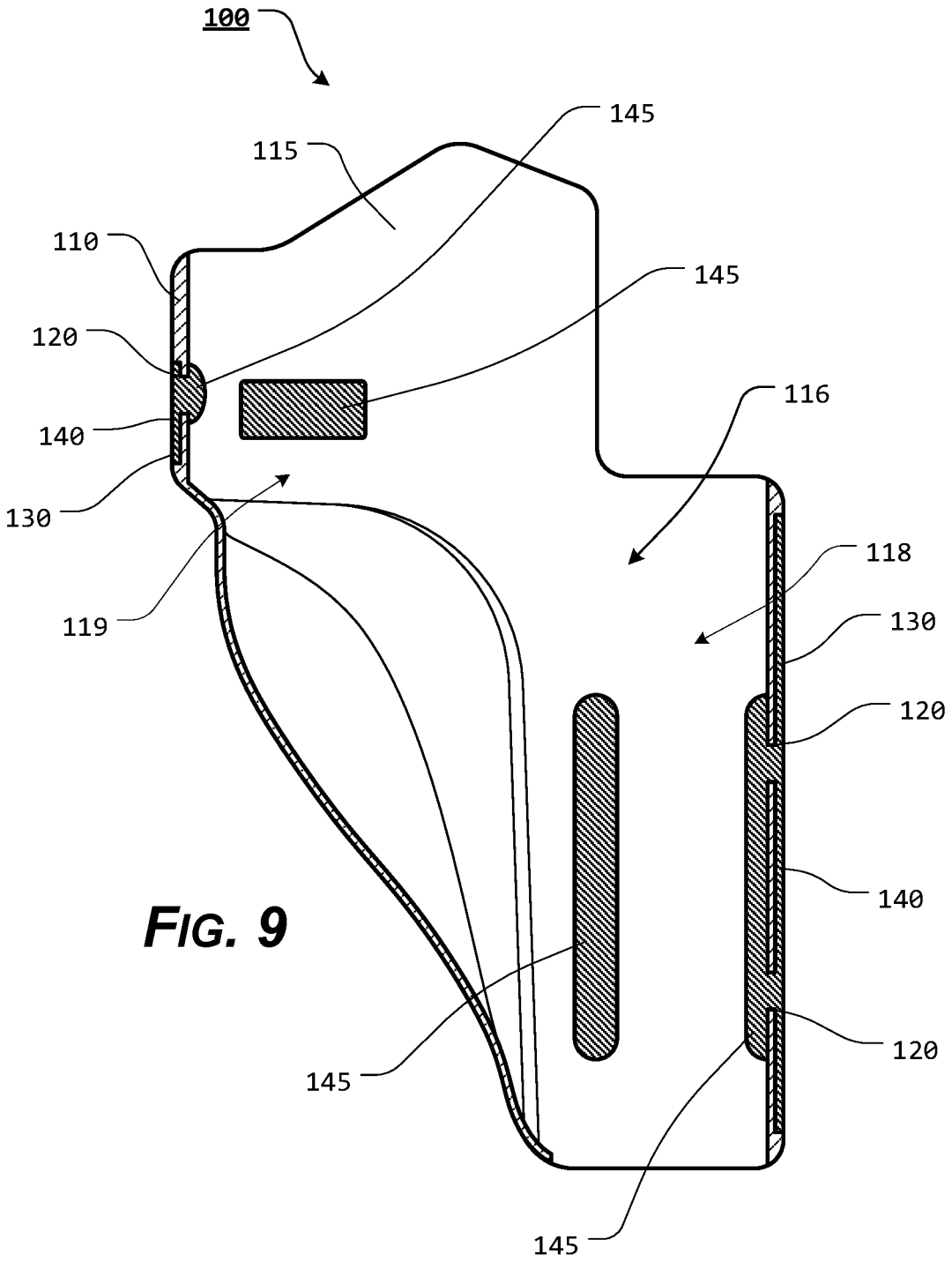
FIG. 9 illustrates a right side, cross-sectional view of an exemplary embodiment of an overmolded/through-molded pouch, according to the presently disclosed systems, methods, and/or apparatuses.
Figure 10:
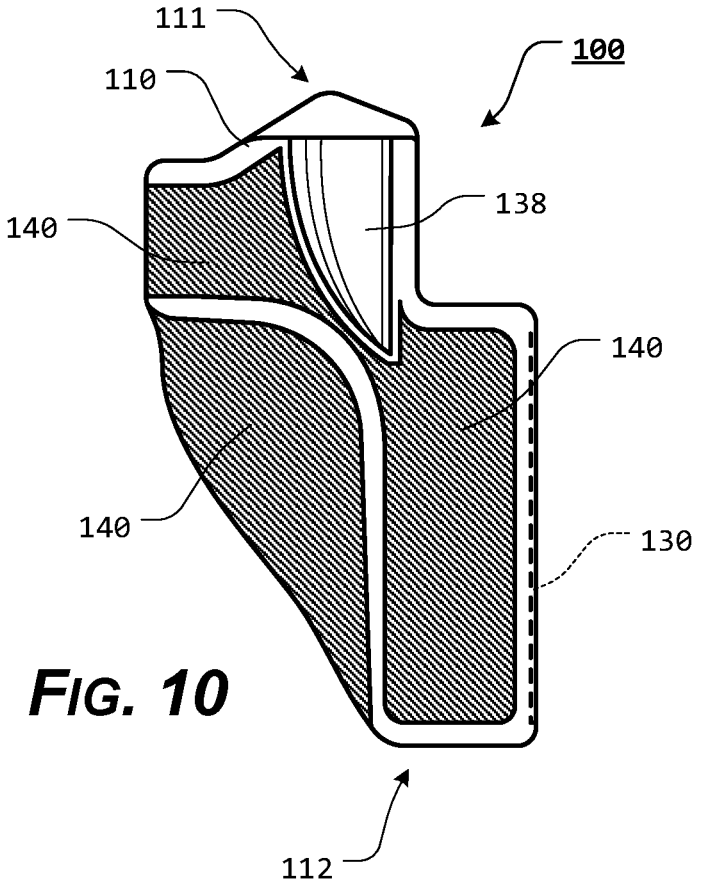
FIG. 10 illustrates a right side view of an exemplary embodiment of an overmolded/through-molded pouch, according to the presently disclosed systems, methods, and/or apparatuses.
Figure 11:
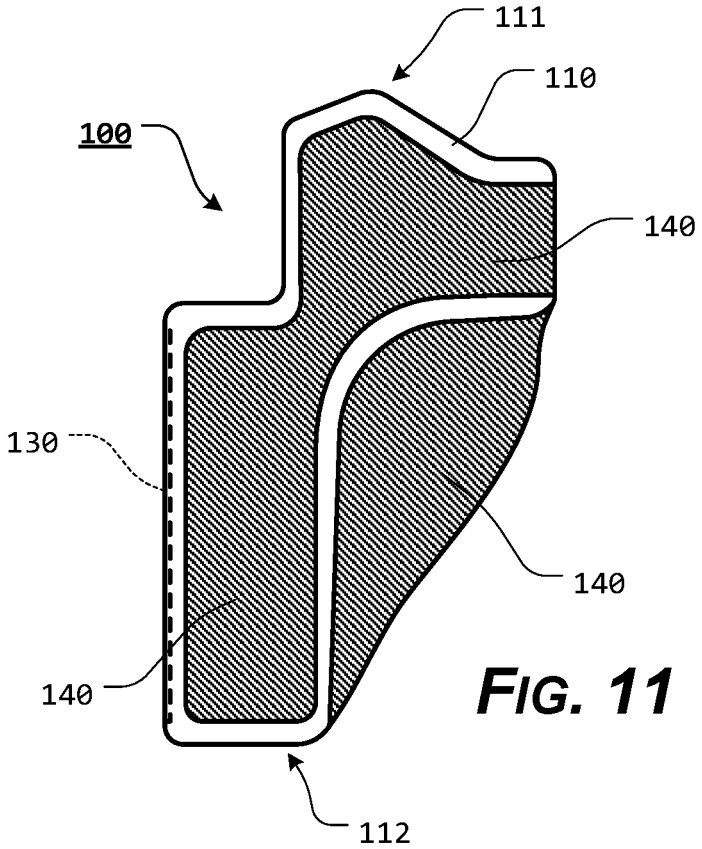
FIG. 11 illustrates a left side view of an exemplary embodiment of an overmolded/through-molded pouch, according to the presently disclosed systems, methods, and/or apparatuses.
Figure 12:
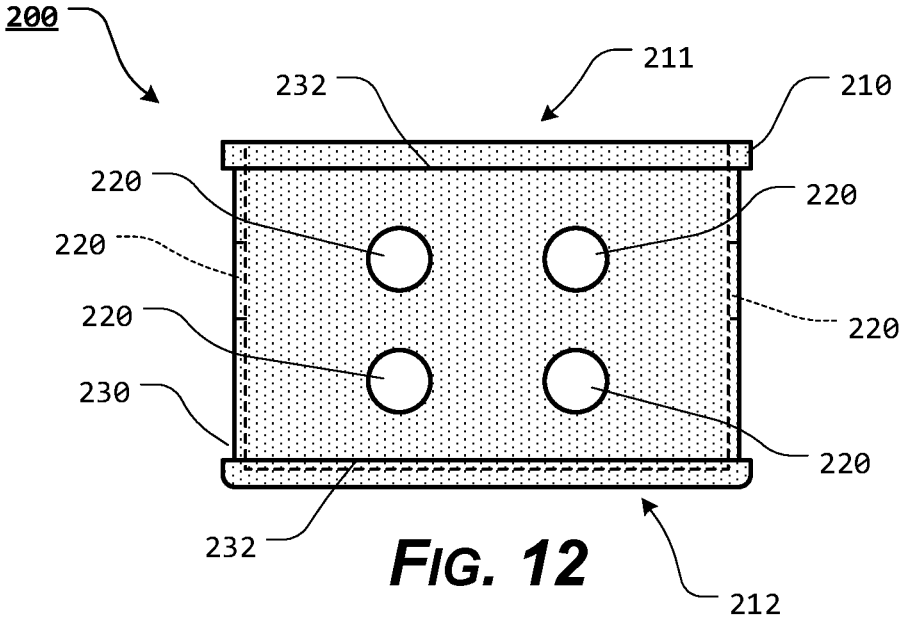
FIG. 12 illustrates a front view of an exemplary embodiment of a pouch body, according to the presently disclosed systems, methods, and/or apparatuses.
Figure 13:
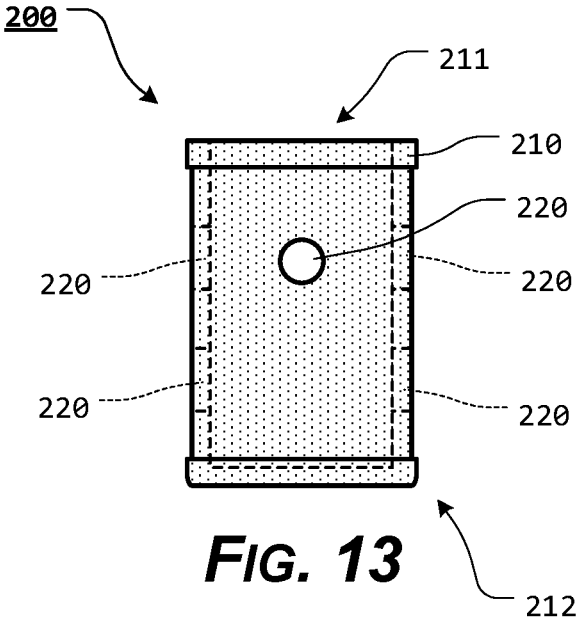
FIG. 13 illustrates a right side view of an exemplary embodiment of an overmolded/through-molded pouch, according to the presently disclosed systems, methods, and/or apparatuses.
Figure 14:
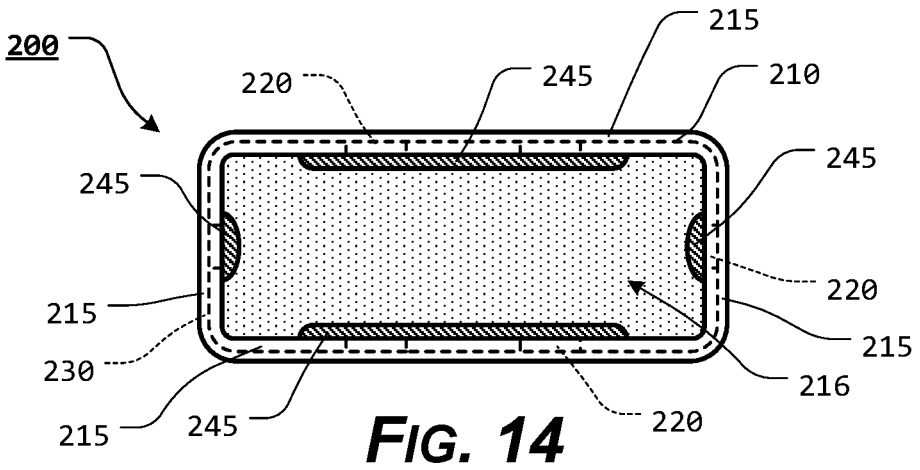
FIG. 14 illustrates a top view of an exemplary embodiment of an overmolded/through-molded pouch, according to the presently disclosed systems, methods, and/or apparatuses.
Figure 15:
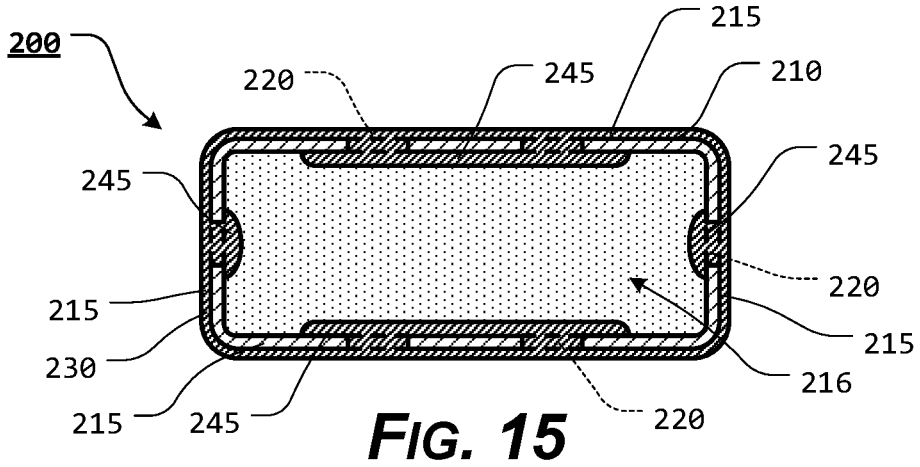
FIG. 15 illustrates a top, cross-sectional view of an exemplary embodiment of an overmolded/through-molded pouch, according to the presently disclosed systems, methods, and/or apparatuses.
Figure 16:
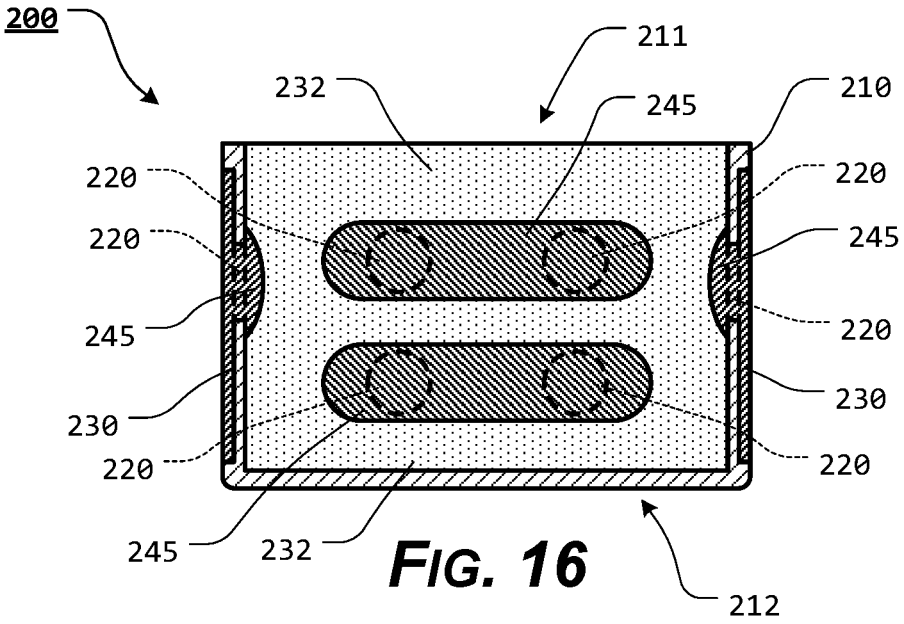
FIG. 16 illustrates a front, cross-sectional view of an exemplary embodiment of an overmolded/through-molded pouch, according to the presently disclosed systems, methods, and/or apparatuses.

For simplicity and clarification, the design factors and operating principles of the overmolded/through-molded pouch according to the presently disclosed systems, methods, and/or apparatuses are explained with reference to various exemplary embodiments of an overmolded/through-molded pouch according to the presently disclosed systems, methods, and/or apparatuses. The basic explanation of the design factors and operating principles of the overmolded/through-molded pouch is applicable for the understanding, design, and operation of the overmolded/through-molded pouch of the presently disclosed systems, methods, and/or apparatuses. It should be appreciated that the overmolded/through-molded pouch can be adapted to many applications where a pouch or carrier can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "overmolded/through-molded" and "pouch" are used for a basic explanation and understanding of the operation of the systems, methods, and apparatuses of the present disclosure. Therefore, the terms "overmolded/through-molded" and "pouch" are not to be construed as limiting the systems, methods, and apparatuses of the present disclosure.

Furthermore, it should be appreciated that, for simplicity and clarification, the embodiments of the present disclosure will be described with reference to a semiautomatic-type item or accessory being utilized in conjunction with the overmolded/through-molded pouch of the present disclosure. However, it should be appreciated that the operating principles of the disclosed overmolded/through-molded pouch may also be employed to construct overmolded/through-molded pouches or holders for any revolver or semiautomatic-type item or accessory, edged weapon, and/or less than lethal product (i.e., tasers, pepper spray, mace canisters, or batons). Furthermore, it is also within the scope of the present disclosure that the present overmolded/through-molded pouch may be employed as a pouch or holder for tactical accessories, such as ammunition magazines and/or flashlights, as well as for everyday items such as cell phones or personal digital assistants.

Turning now to the appended drawing figures, FIGS. 1-11 illustrate certain elements and/or aspects of an overmolded/through-molded pouch 100 according to the present disclosure, while FIGS. 12-21 illustrate certain elements and/or aspects of an overmolded/through-molded pouch 200 according to the present disclosure.

It should be appreciated that, by way of illustration and not limitation, the overmolded/through-molded pouch 100 is illustrated as being adapted to retain an item or accessory consisting of a semiautomatic-type handgun, while the overmolded/through-molded pouch 200 is illustrated as being adapted to retain an item or accessory. The semiautomatic-type handgun generally includes a slide portion and a frame portion. The frame portion generally includes a dust cover, a grip, a trigger guard, and a trigger. The trigger guard includes an inner surface, which defines an area wherein the trigger is located and allows a user's finger access to the trigger, and an outer surface, which defines the outer perimeter of the trigger guard.

In illustrative, non-limiting embodiment(s) of the presently disclosed systems, methods, and/or apparatuses, as illustrated in FIGS. 1-11, the illustrated, exemplary overmolded/through-molded pouch 100 includes a pouch body 110 defining an at least partial pouch cavity 116 for receiving and holding the handgun. In various exemplary embodiments, one or more wall portions 115 define the pouch body 110. The pouch body 110 extends from a substantially open top portion 111 to a bottom portion 112. In these exemplary embodiments, the one or more wall portions 115 define the at least partial pouch cavity 116 of the pouch body 110.

In various exemplary, nonlimiting embodiments, the pouch body 110 is formed from a first side wall portion, a second side wall portion, a front wall portion, and a rear wall portion.

However, it should be appreciated that the overmolded/through-molded pouch 100 may be formed such that one or more wall portions 115 define the at least partial pouch cavity 116 for receiving the handgun. In these exemplary embodiments, the at least partial pouch cavity 116 may be formed from any number or combination of sidewalls, side, front, and/or rear walls, or wall portions 115, including, for example, a single, continuous wall portion 115 or multiple coupled or joined wall portions 115. Thus, the at least partial pouch cavity 116 may be formed by any pouch cavity 116, partial pouch cavity 116, space, or platform that is capable of retaining a portion of the handgun.

In certain exemplary, nonlimiting embodiments, the pouch body 110 merely comprises a single wall portion 115, such as, for example, the first wall portion 115. Any remaining portions of the overmolded/through-molded pouch 100 may be attached, coupled, or formed as a portion or extension of the pouch body 110.

In certain exemplary embodiments, the one or more overmold recesses 130 each comprise a recessed portion of the pouch body 110, relative to an outer surface of the pouch body 110.

In certain exemplary, nonlimiting embodiments, as illustrated, the pouch body 110 and/or the at least partial pouch cavity 116 includes a frame/slide portion 118. At least a portion of the frame/slide portion 118 is shaped so as to receive and accommodate at least a portion of the frame and/or slide of an inserted handgun. In various exemplary embodiments, the frame/slide portion 118 is generally formed by a portion of the pouch body 110 of the overmolded/through-molded pouch 100. The frame/slide portion 118 is shaped generally to match the contours of at least a portion of the outer surface of the frame and/or slide of a handgun to be inserted within the at least partial pouch cavity 116. The frame/slide portion 118 is formed so as to contact at least a portion of the outer surface of the frame and/or slide of the inserted handgun and at least partially limit movement of the handgun, when the handgun is inserted into the overmolded/through-molded pouch 100.

In certain exemplary, nonlimiting embodiments, as illustrated, the pouch body 110 and/or the at least partial pouch cavity 116 includes a trigger guard portion 119. At least a portion of the trigger guard portion 119 is shaped so as to receive and accommodate at least a portion of the trigger guard of an inserted handgun. In various exemplary embodiments, the trigger guard portion 119 is generally formed by a portion of the pouch body 110 of the overmolded/through-molded pouch 100. The trigger guard portion 119 is shaped generally to match the contours of at least a portion of the outer surface of the trigger guard. The trigger guard portion 119 is formed so as to contact at least a portion of the outer surface of the trigger guard of the inserted handgun and further limit how far the handgun can be inserted into the overmolded/through-molded pouch 100.

It should be noted that the wall portions 115 of the pouch body 110 may generally be planar. Alternatively, the wall portions 115 of the pouch body 110 may be contoured or shaped to better accommodate a specific type or model of handgun to be retained within the overmolded/through-molded pouch 100.

In various exemplary embodiments, a finger trough 138 is formed in at least one of the wall portions 115, so as to further aid in the proper placement of a user's finger on the overmolded/through-molded pouch 100. The finger trough 138, if included, is formed and positioned such that, as the user grips an inserted handgun, the user's index, or other, finger is positioned along the frame of the handgun, between the trigger guard and the slide. Therefore, as the handgun is withdrawn from the overmolded/through-molded pouch 100, the user's index finger is positioned to contact the frame of the handgun, above the trigger guard, and not in or on the trigger guard or the trigger. The finger trough 138 may optionally include a textured portion (not shown), such that the finger trough 138 may be distinguished tactilely from other portions of the overmolded/through-molded pouch 100.

In various exemplary embodiments, the overmolded/through-molded pouch 100 optionally includes at least one pouch attachment portion 114, which provides an area or device for fastening the overmolded/through-molded pouch 100 to a pouch holding device. Alternatively, the means for pouch attachment portion 114 may comprise a clip or hook adapted to, for example, be clipped over or to a belt. In further exemplary embodiments, the pouch attachment portion 114 may comprise one or more quick-disconnect or other couplings, which may be permanently or removably coupled to corresponding and cooperating coupling(s) provided on a belt or other carrier or platform. In still other exemplary embodiments, the overmolded/through-molded pouch 100 may comprise an integral belt, or may comprise one or more connections for attachment to a chest, ankle, leg, shoulder, or other harness or band, or for otherwise securing the overmolded/through-molded pouch 100 to a user or the user's apparel.

In various exemplary embodiments, the pouch body 110 is substantially rigid and is formed of a polymeric material such as a polymeric composite. Thus, the pouch body 110 provides a skeleton or platform for the overmolding material 140 (which provides texture or shape to at least a portion of the exterior of the overmolded/through-molded pouch 100) and the through-body protrusion 145 (which provide shape, interior dimensioning, and frictional engagement areas for the at least partial pouch cavity 116 of the overmolded/through-molded pouch 100).

Alternate materials of construction of the pouch body 110 may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the pouch body 110 are generally substantially rigid, but are a design choice based on the desired appearance and functionality of the overmolded/through-molded pouch 100.

In various exemplary, nonlimiting embodiments, a longitudinal axis, $A_L$, of the pouch body 110 extends generally from the top portion 111 to the bottom portion 112.

In various exemplary, nonlimiting embodiments, the at least partial pouch cavity 116 includes a frame/slide portion 118 and a trigger guard portion 119. In certain of the exemplary embodiments, a depth of the frame/slide portion 118 is different from a depth of the trigger guard portion 119.

In various exemplary, nonlimiting embodiments, at least a portion of the at least partial pouch cavity 116 (or at least a portion of at least one of the one or more wall portions 115) is contoured to accommodate a specific type or model of handgun to be retained within the c.

At least one overmold aperture 120 is formed through a portion of one or more of the wall portions 115. As illustrated, a plurality of overmold apertures 120 may be formed through one or more portions of one or more of the wall portions 115. The number, size, shape, and placement of the overmold apertures 120 is a design choice. Each overmold aperture 120 allows at least some of an overmolding material 140 to extend through the overmold aperture 120, such that at least a portion of the overmolding material 140 extends through at least a portion of the at least one overmold aperture 120 and into at least a portion of the at least partial pouch cavity 116.

In various exemplary, nonlimiting embodiments, at least one overmold recess 130 is formed in at least a portion of an exterior surface of the pouch body 110. In these exemplary embodiments, the at least one overmold aperture 120 is formed through a portion of one or more of the one or more wall portions 115 within the overmold recess 130 and the overmolding material 140 extends within the overmold recess 130. In certain exemplary embodiments, one or more overmold recess ridge segments 132 extend from at least a portion of the exterior surface of the pouch body 110 to define the overmold recess 130.

It should be appreciated that the overmold recesses 130, formed by the overmold recess ridge segments 132 are optional and the overmolding material 140 may be applied so as to extend atop a portion of an exterior surface of the pouch body 110.

The overmolding material 140 extends atop at least a portion of an exterior surface of the pouch body 110. The overmolding material 140 is attached or coupled to at least a portion of the exterior surface of the pouch body 110 as an additional layer of material over at least a portion of the exterior surface of the pouch body 110. If the overmold recess 130 is included, the overmolding material 140 is added as an additional layer of material over at least an exterior surface of the pouch body 110 and optionally within the overmold recess 130.

In various exemplary embodiments, the overmolding material 140 is attached by chemical or adhesive attachment, wherein a portion of the exterior surface of the pouch body 110 is coated with an adhesive and the overmolding material 140 is affixed to the exterior surface of the pouch body 110, via the adhesive. In certain exemplary embodiments, at least a portion of the exterior surface of the pouch body 110 may be scored or altered with surface projections, recesses, or other preparations to provide better attachment or coupling between the exterior surface of the pouch body 110 and the overmolding material 140.

In various exemplary, nonlimiting embodiments, the overmolding material 140 may comprise an at least partially resilient material such as silicon or vulcanized rubber. In this manner, the overmolding material 140 may not only provide a degree of cushion to portions of the exterior of the pouch body 110, but also provide releasable frictional engagement to a pouch positioned within the pouch cavity 116.

In various exemplary embodiments, an outer surface of the overmolding material 140 may be substantially coplanar with a surface of the pouch body 110, outside of the one or more overmold recesses 130. Alternatively, the outer surface of the overmolding material 140 may be recessed from or extend beyond a surface of the pouch body 110, outside of the one or more overmold recesses 130.

In various exemplary embodiments, the surface of the overmolding material 140 may be textured or include tactile variations to provide an ornamental appearance to the overmolding material 140 or tactile recognition of various components or elements of the overmolded/through-molded pouch 100.

Through application of the overmolding material 140, at least a portion of the overmolding material 140 optionally extends through each of the overmold apertures 120, to form a through-body protrusion 145. Each through-body protrusion 145 optionally extends through one or more overmold aperture 120, into at least a portion of the at least partial pouch cavity 116.

By having at least a portion of the overmolding material 140 extend into or through each of the overmold apertures 120, the overmolding material 140 is further anchored or tethered to the pouch body 110.

Each through-body protrusion 145 may optionally extend a desired amount into or through each overmold aperture 120. For example, one or more through-body protrusions 145 may only extend partially into a respective overmold aperture 120. One or more through-body protrusions 145 may extend completely through a respective overmold aperture 120, while not extending past the adjacent wall portion 115 or into the pouch cavity 116. Alternatively, one or more through body protrusions 145 may extend completely through a respective overmold aperture 120 and into at least a portion of the pouch cavity 116. If a respective through-body protrusion 145 extends into at least a portion of the pouch cavity 116, the through-body protrusion 145 may extend so as to have sidewalls that are substantially parallel to the respective overmold aperture 120. Alternatively, the through-body protrusion 145 may extend so as to extend beyond or mushroom beyond the respective overmold aperture 120.

The thickness, texture, and resilience of the overmolding material 140 may be varied, based upon the desired level of resilient interaction or tension provided by the through-body protrusions 145, relative to the at least partial pouch cavity 116 and/or surfaces of an inserted handgun. By varying the material used to form the overmolding material 140 (which allows for variations in thickness, texture, and/or resilience of the overmolding material 140), the degree to which each through-body protrusion 145 extends into the at least partial pouch cavity 116 may be determined or controlled. Additionally, by varying the material used to form the overmolding material 140, a degree of frictional tension or frictional engagement between the through-body protrusions 145 and a handgun positioned within the at least partial pouch cavity 116 can be determined or controlled.

In various exemplary, nonlimiting embodiments, the pouch body 110 is substantially rigid, while the overmolding material 140 is substantially resilient. In certain exemplary embodiments, the overmolding material 140 is formed of a rubber or silicone.

In various exemplary embodiments, the overmolded/through-molded pouch 100 optionally includes at least one pouch attachment portion 114, which provides one or more areas, portions, or devices for fastening the overmolded/through-molded pouch 100 to a holster holding device. Alternatively, the means for pouch attachment portion 114 may comprise a clip or hook adapted to, for example, be clipped over or to a belt. In further exemplary embodiments, the pouch attachment portion 114 may comprise one or more quick-disconnect or other couplings, which may be permanently or removably coupled to corresponding and cooperating coupling(s) provided on a belt or other carrier or platform. In still other exemplary embodiments, the overmolded/through-molded pouch 100 may comprise an integral belt, or may comprise one or more connections for attachment to a chest, ankle, leg, shoulder, or other harness or band, or for otherwise securing the overmolded/through-molded pouch 100 to a user or the user's apparel.

In certain exemplary, nonlimiting embodiments, during formation of the overmolded/through-molded pouch 100, the pouch body 110 is first formed or created. For example, the pouch body 110 may be formed by, for example, injection molding, 3D printing, milling, forming, or may be formed of layers of carbon fiber or other material.

Once the pouch body 110 is formed, it can be placed in a mold and the overmolding material 140 can be formed outside of and around at least a portion of the pouch body 110. The material of the overmolding material 140 is injected or otherwise molded so that various through-body protrusion 145 are formed or extruded into, partially through, or completely through various overmold apertures 120.

In certain exemplary embodiments, because at least a portion of the overmolding material 140 is formed through the overmold apertures 120 and into the pouch cavity 116, a variety of overmolded/through-molded pouches 100 can be formed having a substantially similar exterior, but with differing internal dimensions for the pouch cavity 116.

For example, a single outer mold may be used to form the overmolding material 140 to the pouch body 110, while a variety of different mold inserts can be utilized to create the pouch cavity 116. As the overmolding material 140 from outside the pouch body 110 flows through the overmold apertures 120 and into the pouch cavity 116, the selected mold insert can dictate the size, shape, and/or internal dimensions of the pouch cavity 116. Thus, overmolded/through-molded pouches 100 having a substantially similar exterior can be created for various firearms or devices.

In this manner, a single type or style of pouch body 110 may optionally be utilized to accommodate a variety of patterns of overmolding material 140 and/or through-body protrusions 145. For example, by varying the size, number, and/or placement of through-body protrusions 145 within the pouch cavity 116, the pouch body 110 may be utilized to create an overmolded/through-molded pouch 100, which can accommodate a number of different handgun types.

Thus, the amount of tooling required to produce a variety of overmolded/through-molded pouches 100 is greatly reduced, when compared to the amount of tooling required to produce known pouches.

During use of the overmolded/through-molded pouch 100, as an handgun is inserted into the at least partial pouch cavity 116 of the overmolded/through-molded pouch 100, muzzle first, the handgun is guided into position by at least some portion of the overmolded/through-molded pouch 100, such as, for example, the a wall portion 115 of the pouch cavity 116.

As the handgun is inserted further into the at least partial pouch cavity 116, at least a portion of outer surface of the handgun (whether a portion of the trigger guard or the frame/slide) will slide adjacent or against one or more of the through-body protrusions 145.

As the handgun is fully seated into the overmolded/through-molded pouch 100, at least a portion of the outer surface of the handgun will be positioned against or adjacent one or more of the through-body protrusions 145. Contact between one or more of the outer surfaces of the handgun and the one or more through-body protrusions 145 provides a compressive force or frictional tension to "squeeze" at least portions of the handgun within the at least partial pouch cavity 116. This results in a relatively secure, wiggle or movement free gripping of the handgun within the overmolded/through-molded pouch 100.

In various exemplary embodiments, the overmold apertures 120 and resultant through-body protrusions 145 may be positioned within one or more of the trigger guard portion 119 or the frame/slide portion 118 to contact one or more of the trigger guard or frame/slide of an inserted handgun. The overmold apertures 120 and the resultant through-body protrusions 145 may also be positioned so as to contact one or more surfaces of an accessory attached or coupled to the handgun, such as for example, an illumination or laser projection device.

Similarly, FIGS. 12-21 illustrate certain elements and/or aspects of an overmolded/through-molded pouch 200 according to the present disclosure. It should be understood that the elements of the overmolded/through-molded pouch 200 correspond substantially to and operates similarly to the similarly named and numbered elements of the overmolded/through-molded pouch 100 of FIGS. 1-11.

In various illustrative, non-limiting embodiment(s) of the presently disclosed systems, methods, and/or apparatuses, the illustrated, exemplary overmolded/through-molded pouch 200 includes a pouch body 210 having one or more wall portions 215 defining the pouch body 210 and an at least partial pouch cavity 216 for receiving and holding an item or accessory, such as, for example, a firearm magazine, radio, handcuffs, or other items. The pouch body 210 extends from a substantially open top portion 211 to a bottom portion 212.

In certain exemplary embodiments, the one or more overmold recesses 230 each comprise a recessed portion of the pouch body 210, relative to an outer surface of the pouch body 210.

In various exemplary embodiments, the overmolded/through-molded pouch 200 optionally includes at least one pouch attachment portion 214, which provides an area or device for fastening the overmolded/through-molded pouch 200 to a pouch holding device.

In various exemplary embodiments, the pouch body 210 is substantially rigid and is formed of a polymeric material such as a polymeric composite. Thus, the pouch body 210 provides a skeleton or platform for the overmolding material 240 (which provides texture or shape to at least a portion of the exterior of the overmolded/through-molded pouch 200) and the through-body protrusion 245 (which provide shape, interior dimensioning, and frictional engagement areas for the at least partial pouch cavity 216 of the overmolded/through-molded pouch 200).

Thus, it should be understood that the material or materials used to form the pouch body 210 are generally substantially rigid, but are a design choice based on the desired appearance and functionality of the overmolded/through-molded pouch 200.

At least one overmold aperture 220 is formed through a portion of one or more of the wall portions 215. As illustrated, a plurality of overmold apertures 220 may be formed through one or more portions of one or more of the wall portions 215. The number, size, shape, and placement of the overmold apertures 220 is a design choice. Each overmold aperture 220 allows at least some of an overmolding material 240 to extend through the overmold aperture 220, such that at least a portion of the overmolding material 240 extends through at least a portion of the at least one overmold aperture 220 and into at least a portion of the at least partial pouch cavity 216.

In various exemplary, nonlimiting embodiments, at least one overmold recess 230 is formed in at least a portion of an exterior surface of the pouch body 210. In these exemplary embodiments, the at least one overmold aperture 220 is formed through a portion of one or more of the one or more wall portions 215 within the overmold recess 230 and the overmolding material 240 extends within the overmold recess 230. In certain exemplary embodiments, one or more overmold recess ridge segments 232 extend from at least a portion of the exterior surface of the pouch body 210 to define the overmold recess 230.

It should be appreciated that the overmold recesses 230, formed by the overmold recess ridge segments 232 are optional and the overmolding material 240 may be applied so as to extend atop a portion of an exterior surface of the pouch body 210.

The overmolding material 240 extends atop at least a portion of an exterior surface of the one or more wall portions 215. The overmolding material 240 is attached or coupled to at least a portion of the exterior surface of the pouch body 210, within the one or more wall portions 215, as an additional layer of material over at least a portion of the exterior surface of the pouch body 210. If the overmold recess 230 is included, the overmolding material 240 is added as an additional layer of material over at least an exterior surface of the pouch body 210 and optionally within the overmold recess 230.

In various exemplary, nonlimiting embodiments, the overmolding material 240 may comprise an at least partially resilient material such as silicon or vulcanized rubber. In this manner, the overmolding material 240 may not only provide a degree of cushion to portions of the exterior of the pouch body 210, but also provide releasable frictional engagement to a pouch positioned within the pouch cavity 216.

In various exemplary embodiments, an outer surface of the overmolding material 240 may be substantially coplanar with a surface of the pouch body 210, outside of the one or more overmold recesses 230.

Alternatively, the outer surface of the overmolding material 240 may be recessed from or extend beyond a surface of the pouch body 210, outside of the one or more overmold recesses 230.

In various exemplary embodiments, the surface of the overmolding material 240 may be textured or include tactile variations to provide an ornamental appearance to the overmolding material 240 or tactile recognition of various components or elements of the overmolded/through-molded pouch 200.

Through application of the overmolding material 240, at least a portion of the overmolding material 240 optionally extends through each of the overmold apertures 220, to form a through-body protrusion 245. Each through-body protrusion 245 optionally extends through one or more overmold aperture 220, into at least a portion of the at least partial pouch cavity 216.

By having at least a portion of the overmolding material 240 extend into or through each of the overmold apertures 220, the overmolding material 240 is further anchored or tethered to the pouch body 210.

Each through-body protrusion 245 may optionally extend a desired amount into or through each overmold aperture 220. For example, one or more through-body protrusions 245 may only extend partially into a respective overmold aperture 220. One or more through-body protrusions 245 may extend completely through a respective overmold aperture 220, while not extending past the adjacent wall portion 215 or into the pouch cavity 216. Alternatively, one or more through body protrusions 245 may extend completely through a respective overmold aperture 220 and into at least a portion of the pouch cavity 216. If a respective through-body protrusion 245 extends into at least a portion of the pouch cavity 216, the through-body protrusion 245 may extend so as to have sidewalls that are substantially parallel to the respective overmold aperture 220. Alternatively, the through-body protrusion 245 may extend so as to extend beyond or mushroom beyond the respective overmold aperture 220.

The thickness, texture, and resilience of the overmolding material 240 may be varied, based upon the desired level of resilient interaction or tension provided by the through-body protrusions 245, relative to the at least partial pouch cavity 216 and/or surfaces of an inserted handgun. By varying the material used to form the overmolding material 240 (which allows for variations in thickness, texture, and/or resilience of the overmolding material 240), the degree to which each through-body protrusion 245 extends into the at least partial pouch cavity 216 may be determined or controlled. Additionally, by varying the material used to form the overmolding material 240, a degree of frictional tension or frictional engagement between the through-body protrusions 245 and a handgun positioned within the at least partial pouch cavity 216 can be determined or controlled.

In various exemplary, nonlimiting embodiments, the pouch body 210 is substantially rigid, while the overmolding material 240 is substantially resilient. In certain exemplary embodiments, the overmolding material 240 is formed of a rubber or silicone.

Figure 17:
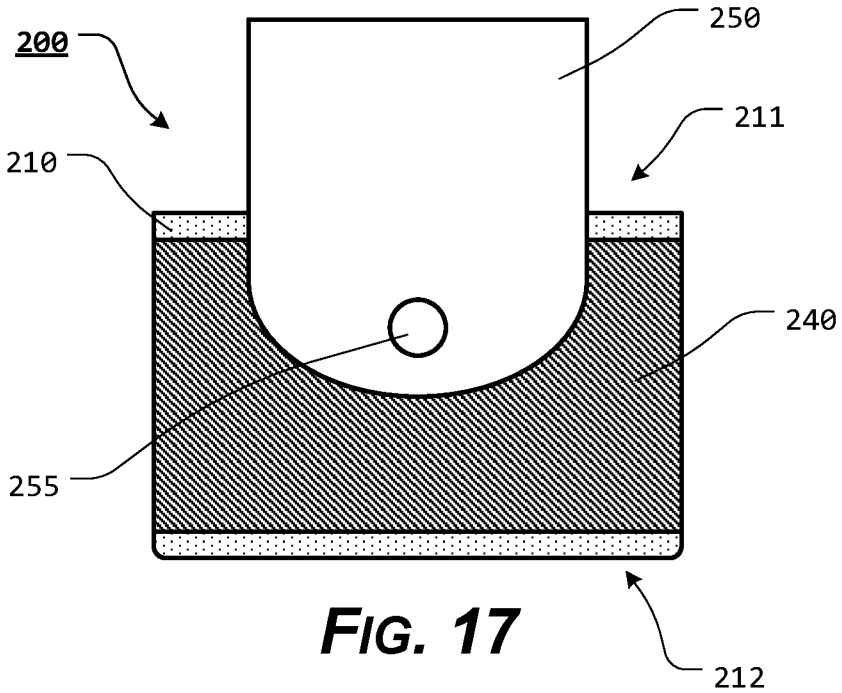
FIG. 17 illustrates a front view of an exemplary embodiment of an overmolded/through-molded pouch, according to the presently disclosed systems, methods, and/or apparatuses.
Figure 18:
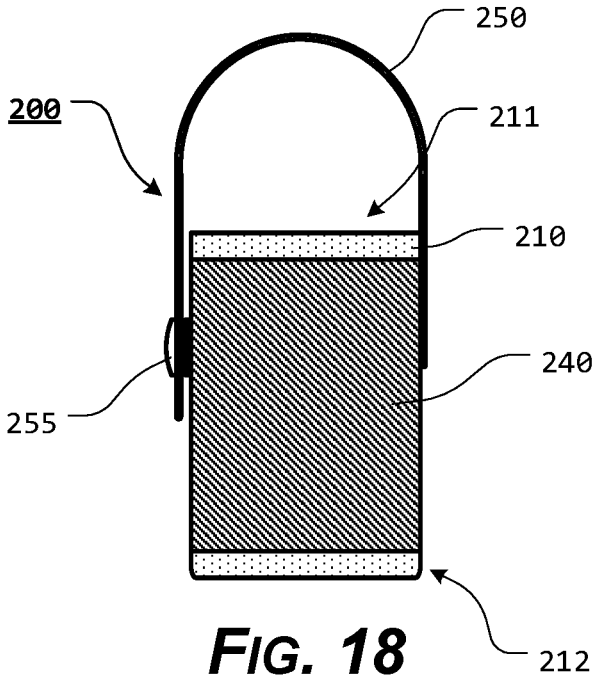
FIG. 18 illustrates a right side view of an exemplary embodiment of an overmolded/through-molded pouch, according to the presently disclosed systems, methods, and/or apparatuses.
Figure 19:
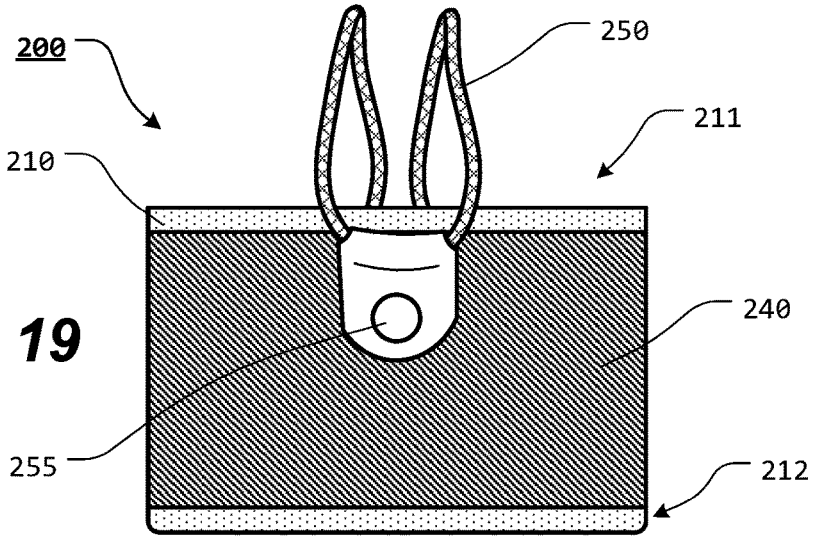
FIG. 19 illustrates a front view of an exemplary embodiment of an overmolded/through-molded pouch, according to the presently disclosed systems, methods, and/or apparatuses.

Some exemplary embodiments of the overmolded/through-molded pouch 200, as illustrated in FIGS. 17-19 (and/or optionally the overmolded/through-molded pouch 100), include a flap 250, which may be a flap, hood, thumb break, retention strap, etc. The flap 250 is a retention device that helps retain an inserted accessory within the at least partial pouch cavity 216. In some exemplary embodiments, the flap 250 may optionally comprise an extension of the overmolding material 240 or may optionally comprise a separate portion of material that is permanently or releasably attached or coupled to a portion of the overmolding material 240 and/or the pouch body 210. In certain exemplary embodiments, the flat 250 comprises a retention strap formed of a portion of bungee or other cord.

In certain exemplary embodiments, a flap closing means 255 may selectively removably connect a portion of the flap 250 to a desired location on the pouch body 210 so that the flap 250 may be utilized to cover the contents of the overmolded/through-molded pouch 200 when the flap 250 has been selectively attached to the overmolded/through-molded pouch 200. In such embodiments, a flap closing means 255 may be a snap, hook & loop, tie, clamp, magnet, etc.

Figure 20:
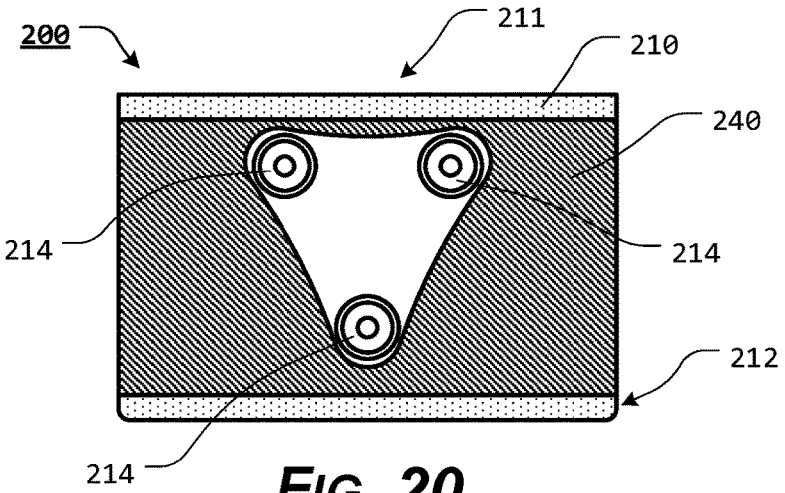
FIG. 20 illustrates a rear view of an exemplary embodiment of an overmolded/through-molded pouch, according to the presently disclosed systems, methods, and/or apparatuses.
Figure 21:
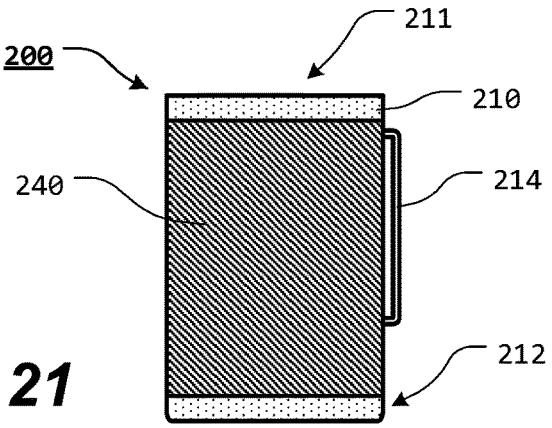
FIG. 21 illustrates a right side view of an exemplary embodiment of an overmolded/through-molded pouch, according to the presently disclosed systems, methods, and/or apparatuses.

In various exemplary embodiments, as illustrated in FIGS. 20-21, the overmolded/through-molded pouch 200 optionally includes at least one pouch attachment portion 214, which provides one or more areas, portions, or devices for fastening the overmolded/through-molded pouch 200 to a holster holding device. Alternatively, the pouch attachment portion 214 may comprise a clip or hook adapted to, for example, be clipped over or to a belt. As illustrated, for example, in FIG. 20, the pouch attachment portion 214 may optionally comprise a belt loop.

In further exemplary embodiments, the pouch attachment portion 214 may comprise one or more quick-disconnect or other couplings, which may be permanently or removably coupled to corresponding and cooperating coupling(s) provided on a belt or other carrier or platform. In still other exemplary embodiments, the overmolded/through-molded pouch 200 may comprise an integral belt, or may comprise one or more connections for attachment to a chest, ankle, leg, shoulder, or other harness or band, or for otherwise securing the overmolded/through-molded pouch 200 to a user or the user's apparel.

In certain exemplary, nonlimiting embodiments, during formation of the overmolded/through-molded pouch 200, the pouch body 210 is first formed or created. For example, the pouch body 210 may be formed by, for example, injection molding, 3D printing, milling, forming, or may be formed of layers of carbon fiber or other material.

Once the pouch body 210 is formed, it can be placed in a mold and the overmolding material 240 can be formed outside of and around at least a portion of the pouch body 210. The material of the overmolding material 240 is injected or otherwise molded so that various through-body protrusion 245 are formed or extruded into, partially through, or completely through various overmold apertures 220.

In certain exemplary embodiments, because at least a portion of the overmolding material 240 is formed through the overmold apertures 220 and into the pouch cavity 216, a variety of overmolded/through-molded pouches 200 can be formed having a substantially similar exterior, but with differing internal dimensions for the pouch cavity 216.

For example, a single outer mold may be used to form the overmolding material 240 to the pouch body 210, while a variety of different mold inserts can be utilized to create the pouch cavity 216. As the overmolding material 240 from outside the pouch body 210 flows through the overmold apertures 220 and into the pouch cavity 216, the selected mold insert can dictate the size, shape, and/or internal dimensions of the pouch cavity 216. Thus, overmolded/through-molded pouches 200 having a substantially similar exterior can be created for various firearms or devices.

In this manner, a single type or style of pouch body 210 may optionally be utilized to accommodate a variety of patterns of overmolding material 240 and/or through-body protrusions 245. For example, by varying the size, number, and/or placement of through-body protrusions 245 within the pouch cavity 216, the pouch body 210 may be utilized to create an overmolded/through-molded pouch 200, which can accommodate a number of different items.

Thus, the amount of tooling required to produce a wide variety of overmolded/through-molded pouches 200 is greatly reduced, when compared to the amount of tooling required to produce known pouches.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An overmolded/through-molded pouch, comprising:

a pouch body, wherein said pouch body extends from a substantially open top portion to a bottom portion, and wherein one or more wall portions define a pouch cavity extending from said substantially open top portion;

a plurality of overmold apertures formed through one or more of at least one of said one or more wall portions; and an overmolding material molded atop at least a portion of an exterior surface of said pouch body, wherein said overmolding material forms an additional layer of material molded atop said portion of said exterior surface of said pouch body, wherein at least a portion of said overmolding material extends through at least a portion of each of said plurality of overmold apertures, such that a portion of said overmolding material extends through at least a portion of each of said plurality of overmold apertures to form a plurality of respective through-body protrusions to anchor or tether a portion of said overmolding material to said pouch body, and wherein each of said plurality of respective through-body protrusions extends beyond at least a portion of a respective one of said plurality of overmold apertures and into said pouch cavity.

2. The overmolded/through-molded pouch of claim 1, wherein at least a portion of said overmolding material is attached by chemical or adhesive attachment to said exterior surface of said pouch body.

3. The overmolded/through-molded pouch of claim 1, wherein at least a portion of said pouch cavity is contoured to accommodate a specific type of item or accessory to be retained within said overmolded/through-molded pouch.

4. The overmolded/through-molded pouch of claim 1, wherein at least a portion of at least one of said one or more wall portions is contoured to accommodate a specific type of item or accessory to be retained within said overmolded/through-molded pouch.

5. The overmolded/through-molded pouch of claim 1, wherein said pouch body is substantially rigid.

6. The overmolded/through-molded pouch of claim 1, wherein said overmolding material is substantially resilient.

7. The overmolded/through-molded pouch of claim 1, wherein said overmolding material is formed of a rubber or silicone.

8. The overmolded/through-molded pouch of claim 1, wherein one or more overmold recess ridge segments extend from at least a portion of said exterior surface of said pouch body to define an overmold recess, wherein said plurality of overmold apertures are formed through a portion of one or more of said one or more wall portions within said overmold recess, and wherein said overmolding material extends within said overmold recess.

9. The overmolded/through-molded pouch of claim 1, wherein at least one overmold recess is formed in at least a portion of an exterior surface of said pouch body, wherein said plurality of overmold apertures are formed through a portion of one or more of said one or more wall portions within said overmold recess, and wherein said overmolding material extends within said overmold recess.

10. The overmolded/through-molded pouch of claim 1, wherein at least a portion of at least one of said plurality of respective through-body protrusions extends so as to mushroom beyond at least a portion of a respective one of said plurality of overmold apertures and into said pouch cavity.

11. The overmolded/through-molded pouch of claim 1, wherein at least a portion of a surface of said overmolding material is textured to provide an ornamental appearance to at least a portion of said surface of said overmolding material.

12. The overmolded/through-molded pouch of claim 1, wherein at least a portion of a surface of said overmolding material includes tactile variations.

13. An overmolded/through-molded pouch, comprising:

a pouch body portion, wherein one or more wall portions define a pouch cavity of said pouch body portion;

at least one overmold recess formed in at least a portion of an exterior surface of said pouch body portion, wherein three or more overmold apertures are formed through one or more of said one or more wall portions within said overmold recess; and an overmolding material molded atop at least a portion of an exterior surface of said pouch body portion, within said at least one overmold recess, wherein said overmolding material forms an additional layer of material molded atop said portion of said exterior surface of said pouch body portion, wherein at least a portion of said overmolding material extends through said three or more overmold apertures to form through-body protrusions to anchor or tether a portion of said overmolding material to said pouch body portion, and wherein a portion of each of said through-body protrusions extends through and beyond said at least one overmold aperture, into said pouch cavity.

14. The overmolded/through-molded pouch of claim 13, wherein a portion of each of said through-body protrusions extends to mushroom beyond at least a portion of a respective overmold aperture.

15. The overmolded/through-molded pouch of claim 13, wherein one or more overmold recess ridge segments extend from at least a portion of said exterior surface of said pouch body to define said at least one overmold recess.

16. The overmolded/through-molded pouch of claim 13, wherein said overmolding material is substantially resilient.

17. The overmolded/through-molded pouch of claim 13, wherein said overmolding material extends only within said overmold recess.

18. The overmolded/through-molded pouch of claim 13, wherein an outer surface of said overmolding material is substantially coplanar with an outer surface of said pouch body, outside of said at least one overmold recess.

19. The overmolded/through-molded pouch of claim 13, wherein at least a portion of a surface of said overmolding material is textured.

20. A method for producing an overmolded/through-molded pouch, comprising:

providing a pouch body portion, wherein one or more wall portions define a pouch cavity of said pouch body portion, and wherein at least one overmold aperture is formed through one or more of said one or more wall portions;

providing at least one overmold aperture formed through one or more of said one or more wall portions; and molding an overmolding material atop at least a portion of an exterior surface of said pouch body portion as an additional layer of material molded atop said portion of said exterior surface of said pouch body portion, wherein at least a portion of said overmolding material is injected or molded through said at least one overmold aperture as one or more through-body protrusions to anchor or tether a portion of said overmolding material to said pouch body portion, and wherein each of said one or more through-body protrusions extends through and beyond said at least one overmold aperture, into said pouch cavity.

* * * * *